US005766115A

United States Patent [19]

Huang

[11] Patent Number: 5,766,115

[45] Date of Patent: Jun. 16, 1998

[54] HIP TRAINING DEVICE

[76] Inventor: Kou-Ming Huang, No. 181, Lane 412, Chenhsing Road, Taichung, Taiwan

[21] Appl. No.: 855,164

[22] Filed: May 13, 1997

[51] Int. Cl.[6] ..... A63B 21/22; A63B 22/14

[52] U.S. Cl. ..... 482/110; 482/148

[58] Field of Search ..... 482/110, 146, 482/148, 147, 64, 65

[56] References Cited

U.S. PATENT DOCUMENTS

| | | | |
|---|---|---|---|
| 2,906,532 | 9/1959 | Echols | 482/146 X |
| 4,313,603 | 2/1982 | Simjian | 482/147 |
| 4,391,441 | 7/1983 | Simjian | 482/147 X |
| 5,050,871 | 9/1991 | Douglas | 482/110 |
| 5,449,335 | 9/1995 | Steinfeld | 482/110 |
| 5,618,251 | 4/1997 | Sullivan | 482/146 |
| 5,632,711 | 5/1997 | Hwang | 482/146 X |

FOREIGN PATENT DOCUMENTS

| | | | |
|---|---|---|---|
| 1532066 | 12/1989 | U.S.S.R. | 482/146 |

*Primary Examiner*—Richard J. Apley
*Assistant Examiner*—William LaMarca
*Attorney, Agent, or Firm*—Pro-Techtor International Services

[57] ABSTRACT

The present invention relates to a hip training device, comprising: a base frame, mounted on a horizontal floor; a positioning system, mounted on the base frame; a disc, rotatably supported by the positioning system; and a transmission system, further comprising a vertical bar, eccentrically and rotatably connected to the disc, a horizontal bar, having a front end and a rear end, the front end being attached to the vertical bar, and a rest plate, attached to the rear end of the horizontal bar and pressed against by the abdomen of a user, and having a strap to bind the user to the rest plate; wherein the user during an exercise moves the transmission system with her or his hips, causing a rotational movement of the disc, the disc in turn constraining the transmission system to a circular movement, taking along the user's hips with a training effect for the user's hips.

15 Claims, 5 Drawing Sheets

HIP TRAINING DEVICE

BACKGROUND OF THE INVENTION

1. Field of the Invention

The present invention relates to a hip training device, particularly to a hip training device for effective exercises softening the hip region.

2. Description of Related Art

Among devices for training the hip, the hula hoop is most often used. Its effect for slimming and softening the hips is well known and comes from the swinging movement of the hips needed to rotate the hula hoop. Yet using a hula hoop and benefitting from its effect requires some skills, which are not easy for everyone.

Many other training devices for the hip have entered the marketplace. Those devices employ a belt rotating around the hip. The friction and vibration of this movement massage the hip, but do not really have an exercising effect.

SUMMARY OF THE INVENTION

An object of the present invention is to provide a hip training device, which effectively exercises the hip.

Another object of the present invention is to provide a hip training device, which softens the hip.

A further object of the present invention is to provide a hip training device, which does not require a special technique to be used.

The present invention can be more fully understood by reference to the following description and accompanying drawings.

DETAILED DESCRIPTION OF THE PREFERRED EMBODIMENTS

As shown in all Figures, the hip training device of the present invention mainly comprises a base frame 10, a positioning device 20, a disc 30, and a transmission system 40. The positioning device 20 holds the rotating disc 30 in a horizontal plane on the base frame 10. The driving system is linked eccentrically to the disc 30, transmitting the rotating movement of the disc 30 to the hip of a user, swinging it around with an exercising effect.

Figure 1:
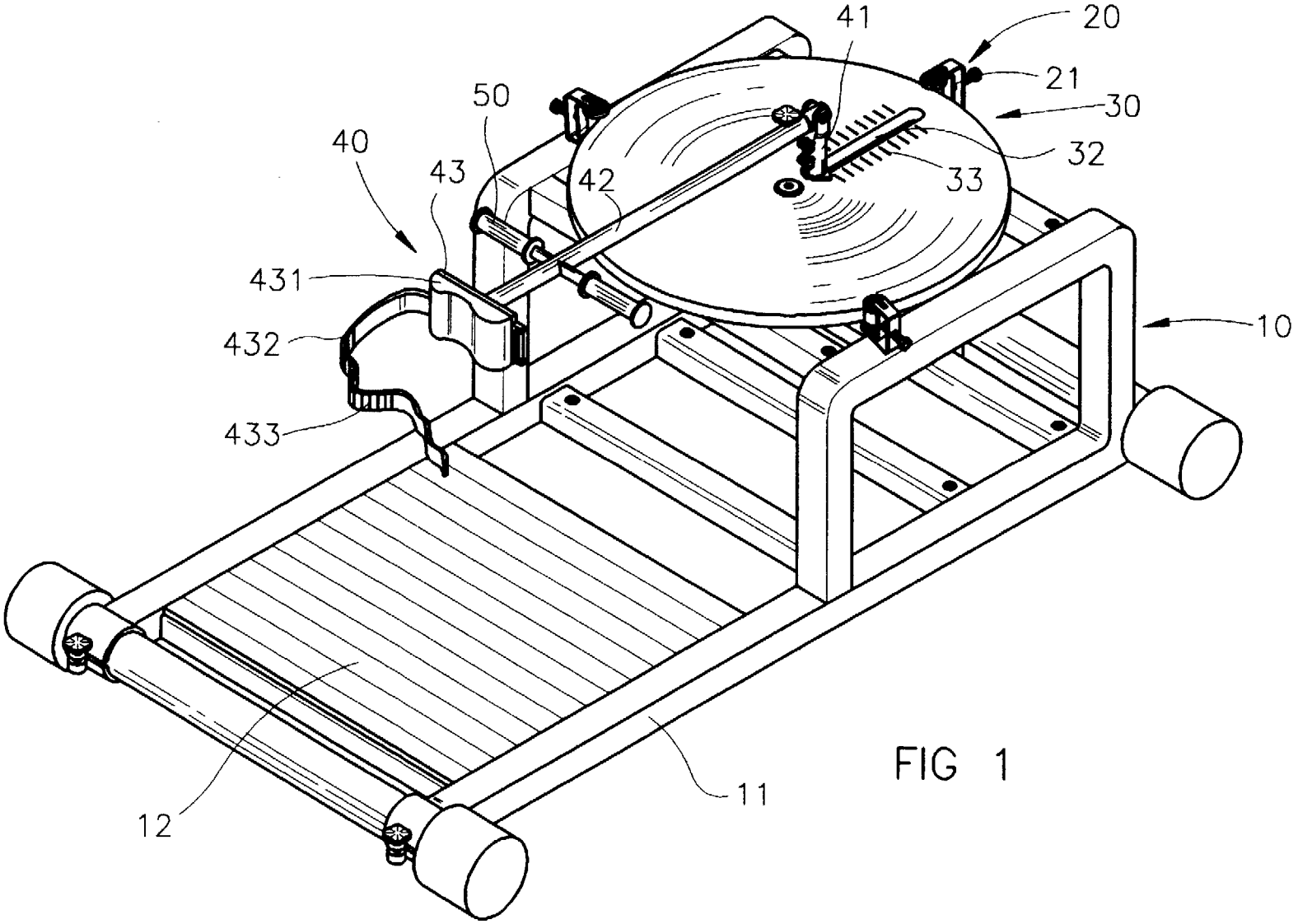
FIG. 1 is a perspective view of the hip training device of the present invention, showing the assembly of the structural parts.

Referring to FIG. 1, the base frame 10 has a front end and a rear end and is of suitable length and width. It is fixed on a floor. The base frame 10 has a lower frame 11, extending towards the rear end. The lower frame 11 carries a horizontal platform 12. When using the hip training device of the present invention, the user stands on the platform 12, facing the front end of the base frame 10, preventing the base frame from moving, while her or his hip is swinging.

The positioning device 20 is mounted on the base frame 10. It comprises several roller devices 21, e.g., three roller devices 21, which are evenly positioned along a common circular line in the horizontal plane. The roller devices 21 surround the disc 30, supporting it.

Figure 2:
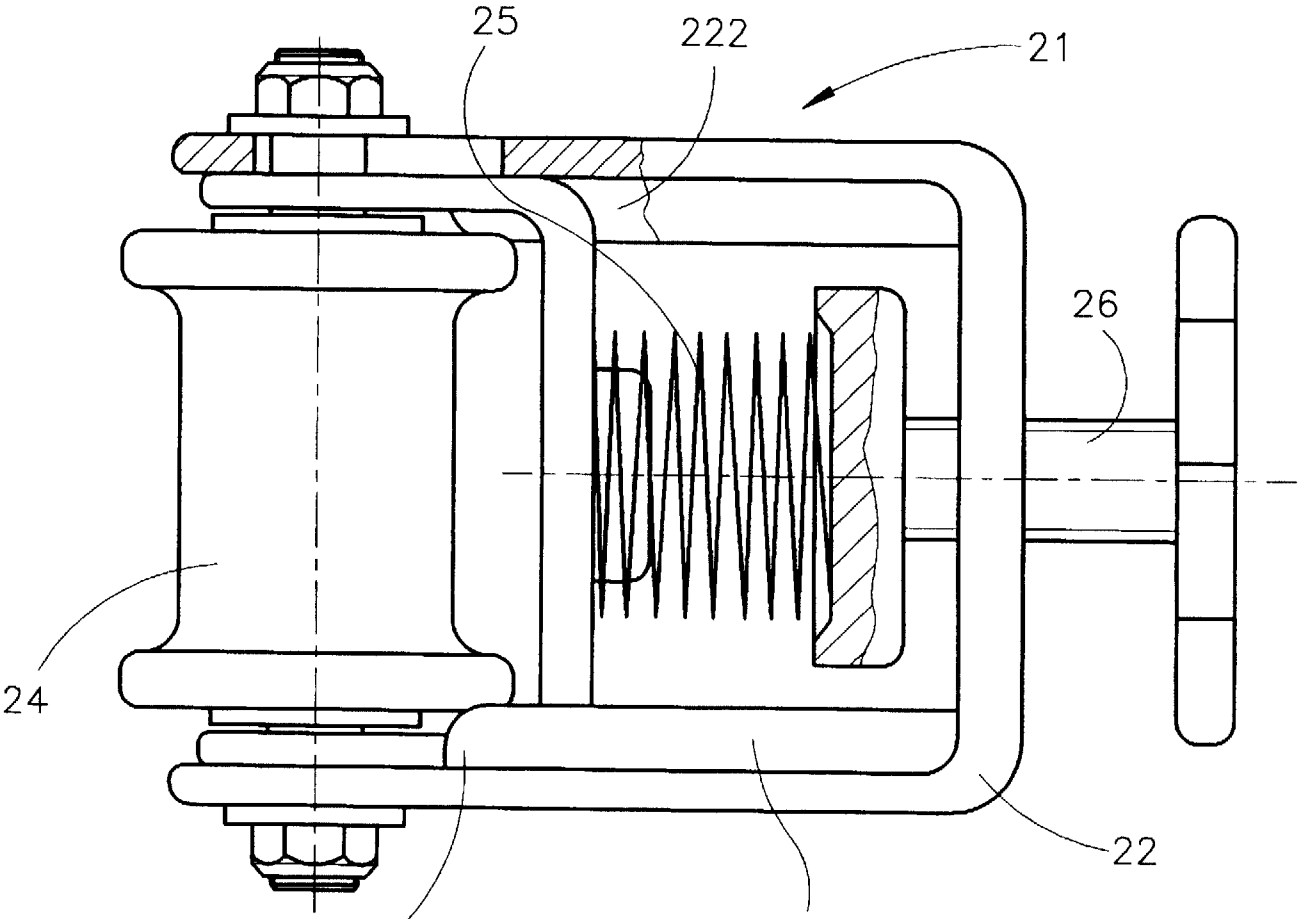
FIG. 2 is a schematic illustration of one of the roller devices of the present invention.

Referring to FIG. 1 and 2, each roller device 21 has an outer frame 22, which is shaped like the letter C with horizontal upper and lower plates, a vertical back plate and an opening. For each roller device 21, the outer frame 22 is mounted on the frame 10, with the opening facing the center of the disc 30. On the inner sides of the upper and lower plates of the outer frame 22, a pair of rims 221 is attached, with a gliding path 222 inside each pair of rims 221 pointing to the center of the disc 30. An inner frame 23 glides in both gliding paths 222 towards the center of the disc 30 or away therefrom. The inner frame 23 is shaped like the letter C with an opening that faces the center of the disc 30. In the opening of the inner frame 23, a roller 24 is inserted with a vertical rotational axis. The disc 30 rolls along the roller 24 of each roller device 21. For each roller device 21, the inner frame 23 is pressed towards the center of the disc 30 by a spring 25, which connects the inner frame 23 with a screw 26 on the back plate of the outer frame 22. By the elastic force of the spring 25, the roller 24 of each roller device 21 is pressed on the periphery of the disc 30 with a force adjustable with the screw 26. Thus the disc 30 rotates stably inside the roller devices 21. The resistance against the rotation of the disc 30 is adjusted with the screws 26.

As shown in FIG. 1, the disc 30 is held horizontally on the base frame 10, its center being movable. An elongated opening 32 is cut from the upper to the lower surface of the disc 30, having marks 33 along its length. The elongated opening 32 extends from a position close to the periphery of the disc 30 towards the center thereof. It allows to link the transmission system 40 to the disc at a variable radial position thereon for adjusting the extent of the swinging movement.

Figure 3:
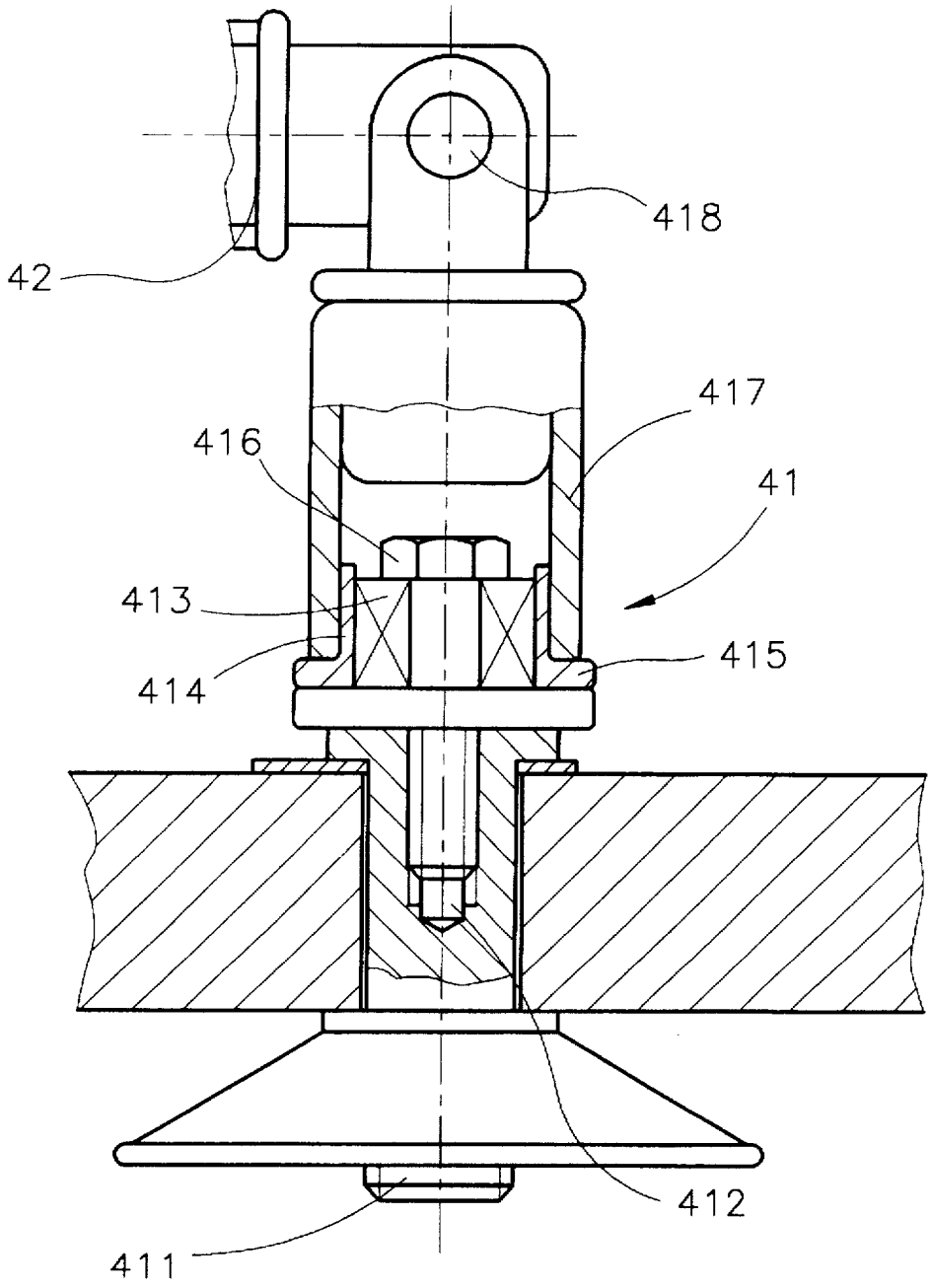
FIG. 3 is a schematic illustration of the vertical bar of the present invention.
Figure 4:
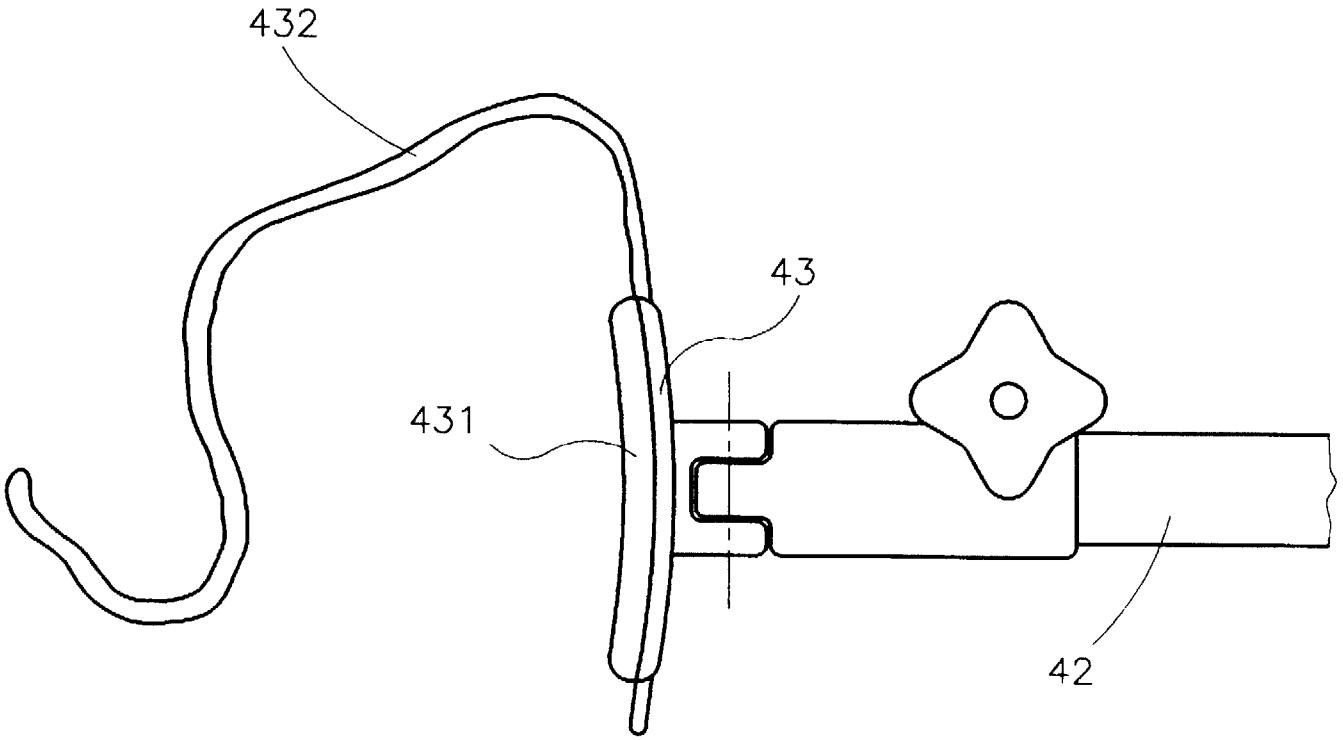
FIG. 4 is a schematic illustration of the rest plate of the present invention.

Referring to FIGS. 1 and 3, the driving system comprises a vertical bar 41, a horizontal bar 42 and a rest plate 43. The vertical bar 41 is eccentrically connected to the disc 30. The lower end of the vertical bar 41 is made as a lower bolt 411, which extends vertically down and is fixed to the elongated opening 32 of the disc 30. The lower bolt 411 has a concentric threaded hole 412, open from the top side thereof. The top side of the vertical bolt 41 carries a concentric sleeve 413, which is fixed by an upper bolt 416 inserted in the threaded hole 412. The lower bolt 411 and the sleeve 413 perform a rotational movement along with the rotation of the disc 30. The sleeve 413 is surrounded by a bearing 414 for reducing rotational friction. The bearing 414 is made of soft material, like plastic or teflon. It has on its lower side a peripheral outward protrusion 415. The bearing 414 connects to a tube 417, which constitutes the upper part of the vertical bar 41.

The tube 417 has a vertical axis concentric to the lower bolt 411 and the sleeve 413. It surrounds the bearing 414, resting on the protrusion 419. The lower bolt 411 and the sleeve 413 rotate against the tube 417, with the rotational friction reduced by the bearing 414. A joint 418 is attached on the upper end of the tube 417.

The horizontal bar 42 has a front end 421 and a rear end 422. The front end 421 is connected to the tube 417 by the joint 418. The rear end 422 extends towards the platform, while being movable up and down. On the rear end 422, the rest plate 43 is attached. The user presses with her or his abdomen against the rest plate 43. Stirring the hip, she or he drives a movement of the rest plate 43, which is transmitted via the horizontal bar 42 to a movement of the vertical bar 41, driving a rotational movement of the disc 30. The rotation of the disc 30 constrains the movement of the vertical bar 41 and of the rest plate 43 to a circular movement.

The rest plate 43 is a curved plate, suiting the curvature of a human abdomen. It is mounted at the rear end 422 of the horizontal bar 42 and thus movable up and down. On one lateral end of the rest plate 43, a strap 432 is attached. The strap 432 is wound around the body of the user, so as to bind the user's abdomen to the rest plate 43. The surface of the strap 432 has marks 433 for measuring the circumference of the user's abdomen and monitoring the effect of exercising. On the surface of the rest plate 43 that faces the user, a cushion 431 is attached to provide a smooth support of the user's abdomen.

Furthermore, a pair of handles 50 is attached to the horizontal bar 42. The handles 50 extend horizontally away from both sides of the horizontal bar 42 and are gripped by both hands of the user, so as to improve the stand of the user during the exercise.

For the exercise, the user binds her or his abdomen to the rest plate 43, then sets the rest plate 43 into motion, driving a rotational movement of the disc 30. The rotation of the disc 30 constrains the movement of the vertical bar 41 and of the rest plate 43 to a circular movement. So the hips of the user perform a swinging, circling movement. Therefore, when the user starts stirring the hips she or he is automatically guided in a circling movement, without needing any skills as to how to swing the hips.

Figure 5:
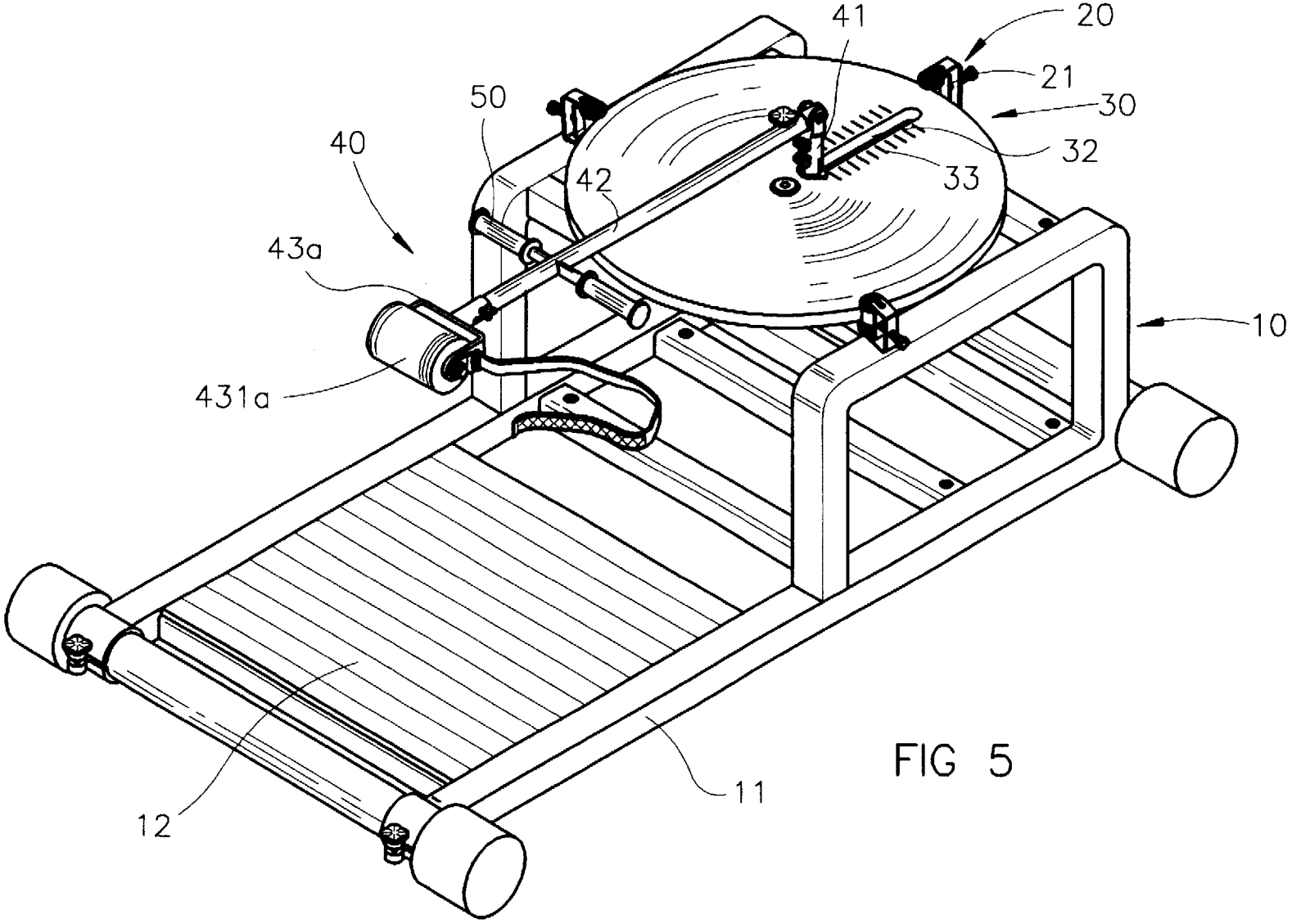
FIG. 5 is a perspective view of the hip training device of the present invention in a second embodiment.

Referring to FIG. 5, the hip training device of the present invention in a second embodiment has a rest plate 43*a*, which is shaped like the letter U open towards the user. A horizontal roll 431*a* with a soft surface is mounted on the rest plate 43. The user's abdomen presses against the roll 431*a*, with a slight vertical movement being allowed during the exercise. Thereby the user moves more flexibly during the exercise.

While the invention has been described with reference to preferred embodiments thereof, it is to be understood that modifications or variations may be easily made without departing from the spirit of this invention which is defined by the appended claims.

What is claimed is:

1. A hip training device, comprising:

a base frame, adapted to rest upon a horizontal floor surface;

a positioning system, mounted on said base frame;

a disc with horizontal upper and lower surfaces, a center and a periphery, rotatably supported by said positioning system; and a transmission system, further comprising a vertical bar, eccentrically and rotatably connected to said disc, a horizontal bar, having a front end and a rear end, said front end being attached to said vertical bar, and a rest plate, attached to said rear end of said horizontal bar, said rest plate having a rear surface, which is adaptable to be pressed against by the abdomen of a user, and having a strap to bind said user to said rest plate;

wherein during exercise said disc is caused to rotate upon movement of said users hips and said disc is constrained to a circular movement path by said transmission system thereby providing a training effect for said user's hips.

2. A hip training device according to claim 1, wherein said base frame has a rear end on which a horizontal platform is mounted adaptable for said user to stand upon thereby preventing said base frame from moving.

3. A hip training device according to claim 1, wherein said positioning device comprises several roller devices around said disc.

4. A hip training device according to claim 3, wherein said several roller devices each comprise:

an outer frame, fixed on said base frame and shaped like the letter C with a vertical back plate and an opening, which points towards said center of said disc;

an inner frame, glidably mounted inside said outer frame and shaped like the letter C with an opening, which points towards said center of said disc;

a roller with a vertical rotational axis, inserted in said opening of said inner frame; and a screw, inserted in a threaded hole in said back plate of said outer frame, pointing towards said opening of said outer frame, pressing against said inner frame;

wherein said roller is pressed against said periphery of said disc with a force that is adjusted by said screw.

5. A hip training device according to claim 4, wherein a spring is inserted between said screw and said inner frame.

6. A hip training device according to claim 3, wherein said several roller devices are three roller devices, which are evenly distributed around said disc.

7. A hip training device according to claim 1, wherein an elongated opening is cut through from said upper surface to said lower surface of said disc, extending from a point close to said periphery of said disc towards said center of said disc, for inserting and fixing said vertical bar of said transmission system in an adjustable radial position, which determines the extent of said circular movement of said disc.

8. A hip training device according to claim 7, wherein said elongated opening has marks, indicating said radial position of said vertical bar.

9. A hip training device according to claim 1, wherein a cushion is attached to said rear surface of said rest plate.

10. A hip training device according to claim 9, wherein said cushion is a roller of soft material with a horizontal rotational axis.

11. A hip training device according to claim 1, wherein said rest plate is rotatable against said horizontal bar.

12. A hip training device according to claim 1, wherein said front end of said horizontal bar is hingedly connected with said vertical bar, with said rear end of said horizontal bar being movable up and down.

13. A hip training device according to claim 1, wherein said vertical bar comprises:

a lower bolt with a top side, said lower bolt being fixed to said disc, said top side having a concentric threaded hole;

a sleeve with a vertical axis on said top side of said lower bolt, concentric with said lower bolt;

an upper bolt, passing through said sleeve, inserted in said threaded hole, thus fixing said sleeve to said lower bolt;

a tube with a vertical axis, an upper end and a lower end, said tube being concentric to said lower bolt, said lower end surrounding said sleeve and said upper end being connected to said horizontal bar by a joint.

14. A hip training device according to claim 13, wherein a bearing lies between said sleeve and said tube, so as to reduce rotational friction, said bearing having a peripheral outward protrusion supporting said tube.

15. A hip training device according to claim 1, wherein said strap has marks for measuring an effect of using said hip training device.

* * * * *